United States Patent [19]

Albiez

[11] Patent Number: 5,052,297

[45] Date of Patent: Oct. 1, 1991

[54] ADJUSTMENT MECHANISM FOR SECTIONALIZED DOCTOR BLADES

[76] Inventor: Patric Albiez, St. Gallerstrasse, CH-8353 Elgg, Switzerland

[21] Appl. No.: 602,148

[22] Filed: Oct. 23, 1990

[30] Foreign Application Priority Data

Oct. 23, 1989 [CH] Switzerland ..... 03815/89

[51] Int. Cl.[5] ..... B41F 31/02

[52] U.S. Cl. ..... 101/365; 101/DIG. 47

[58] Field of Search ..... 101/167, 169, 157, 350, 101/365, DIG. 47; 15/236.01, 236.05

[56] References Cited

U.S. PATENT DOCUMENTS

| | | | |
|---|---|---|---|
| 3,898,931 | 8/1975 | Posselt | 101/365 |
| 4,148,256 | 4/1979 | Fischer | 101/350 |
| 4,193,345 | 3/1980 | Schoneberger et al. | 101/365 |
| 4,510,867 | 4/1985 | Forster et al. | 101/365 |
| 4,530,285 | 7/1985 | Fischer | 101/365 |
| 4,803,923 | 2/1989 | Kenichi | 101/365 |
| 4,977,831 | 12/1990 | Walter | 101/365 |

FOREIGN PATENT DOCUMENTS

| | | | |
|---|---|---|---|
| 2942007 | 4/1981 | Fed. Rep. of Germany | 101/DIG. 47 |
| 3728672 | 3/1988 | Fed. Rep. of Germany | 101/DIG. 47 |
| 0065558 | 4/1980 | Japan | 101/DIG. 47 |
| 0003955 | 1/1988 | Japan | 101/DIG. 47 |

*Primary Examiner*—Eugene H. Eickholt

*Attorney, Agent, or Firm*—Speckman & Pauley

[57] ABSTRACT

An exact setting of an ink supply at a doctor blade of a printing press, in particular an offset printing press, is performed with special set screws, which are positioned in appropriate through-bores directed to sections of the doctor blade. It is possible to make exact, fine adjustments with two-piece set screws having a duct-adjusting screw and a set bolt which have threads with different leads. Each set screw has a counter so that these adjustments can be made without loss of time and paper.

9 Claims, 2 Drawing Sheets

ADJUSTMENT MECHANISM FOR SECTIONALIZED DOCTOR BLADES

BACKGROUND OF THE INVENTION

1. Field of the Invention

This invention relates to an adjustment mechanism for doctor blades of printing presses, in particular offset printing presses, which have been divided into individual sections.

2. Description of Prior Art

When setting the doctor blade of a small to medium sized offset printing press, it is necessary to adjust 16 to 50 set screws, depending on the size. This setting procedure is first performed when the new offset printing press is set up and it must be reset for every printing and/or for every inking. This process is controlled by printing a sheet of paper and measuring the thickness of the ink with a densitometer. Subsequently, the doctor blade is adjusted and a new measurement is taken with the densitometer to determine the new ink density, the doctor blade is again adjusted, and such process is repeated. This process may be repeated many times and takes an extremely long time.

The extremely precise setting requires fine adjustment of the set screws. An appropriate process is known, for example, from German DE-A-2,435,321. Although this improves the accuracy of the setting, it does not shorten the actual setting process. In the course of fine setting, not an inconsiderable amount of waste paper is created, which is not only inefficient, but also environmentally questionable.

SUMMARY OF THE INVENTION

One object of this invention is to provide an adjustment mechanism by which time and paper can be saved during the repeatedly performed setting process.

This object is achieved with a adjustment mechanism which is divided into sections and has a plurality of set screws placed next to each other, with duct-adjusting screws for fine adjustment. The duct-adjusting screws are in active frictional contact with a section of the doctor blade facing a ductor roller. Each duct-adjusting screw is rotated for adjusting each set screw and a counter which counts the rotation.

Additional embodiments of this invention are described below.

One embodiment of this invention is illustrated in the drawings and will be described in detail in the description which follows.

DETAILED DESCRIPTION OF PREFERRED EMBODIMENTS

Figure 1:
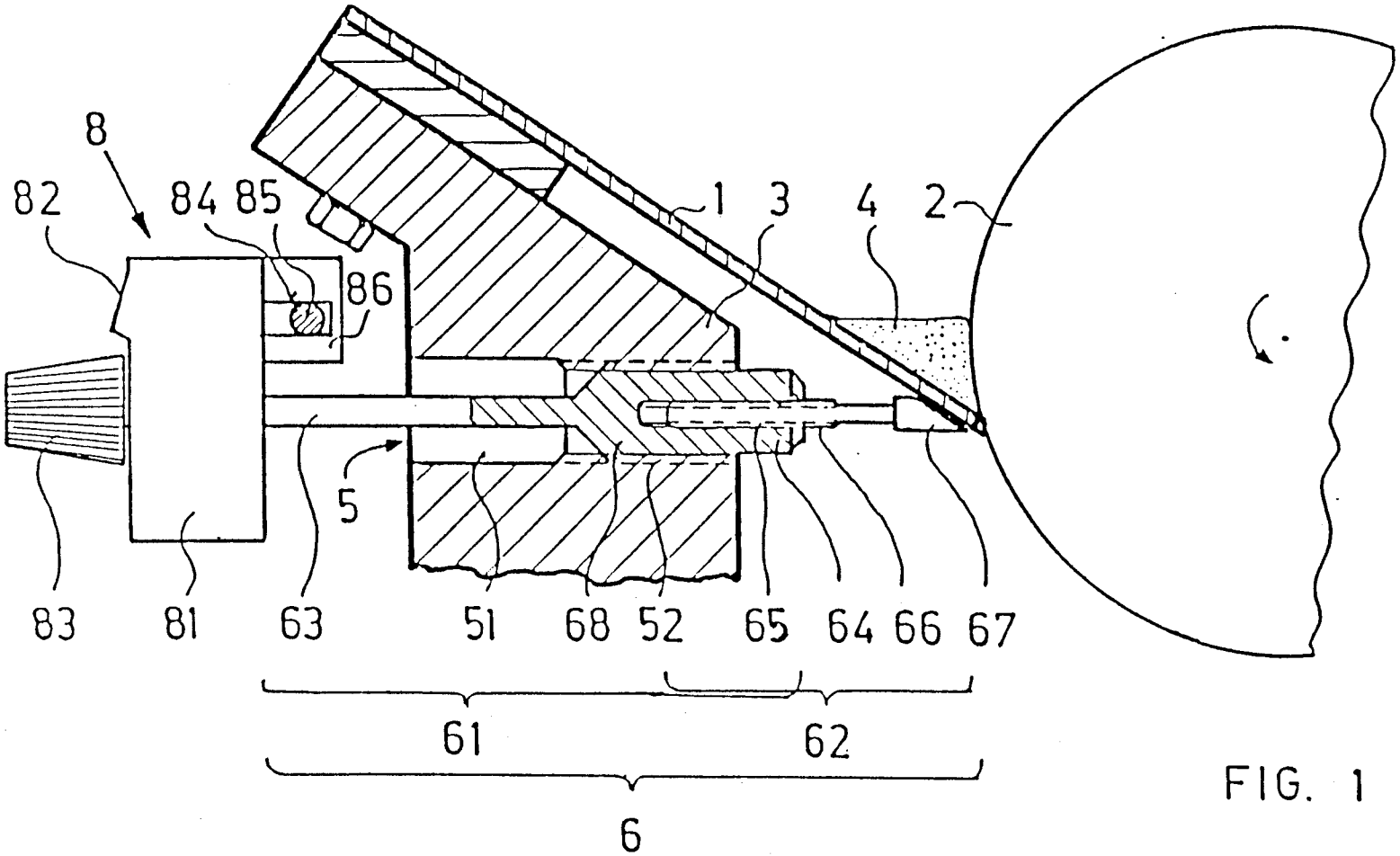
FIG. 1 is a sectional view of the adjustment mechanism crosswise to the longitudinal direction of the doctor blade.
Figure 2:
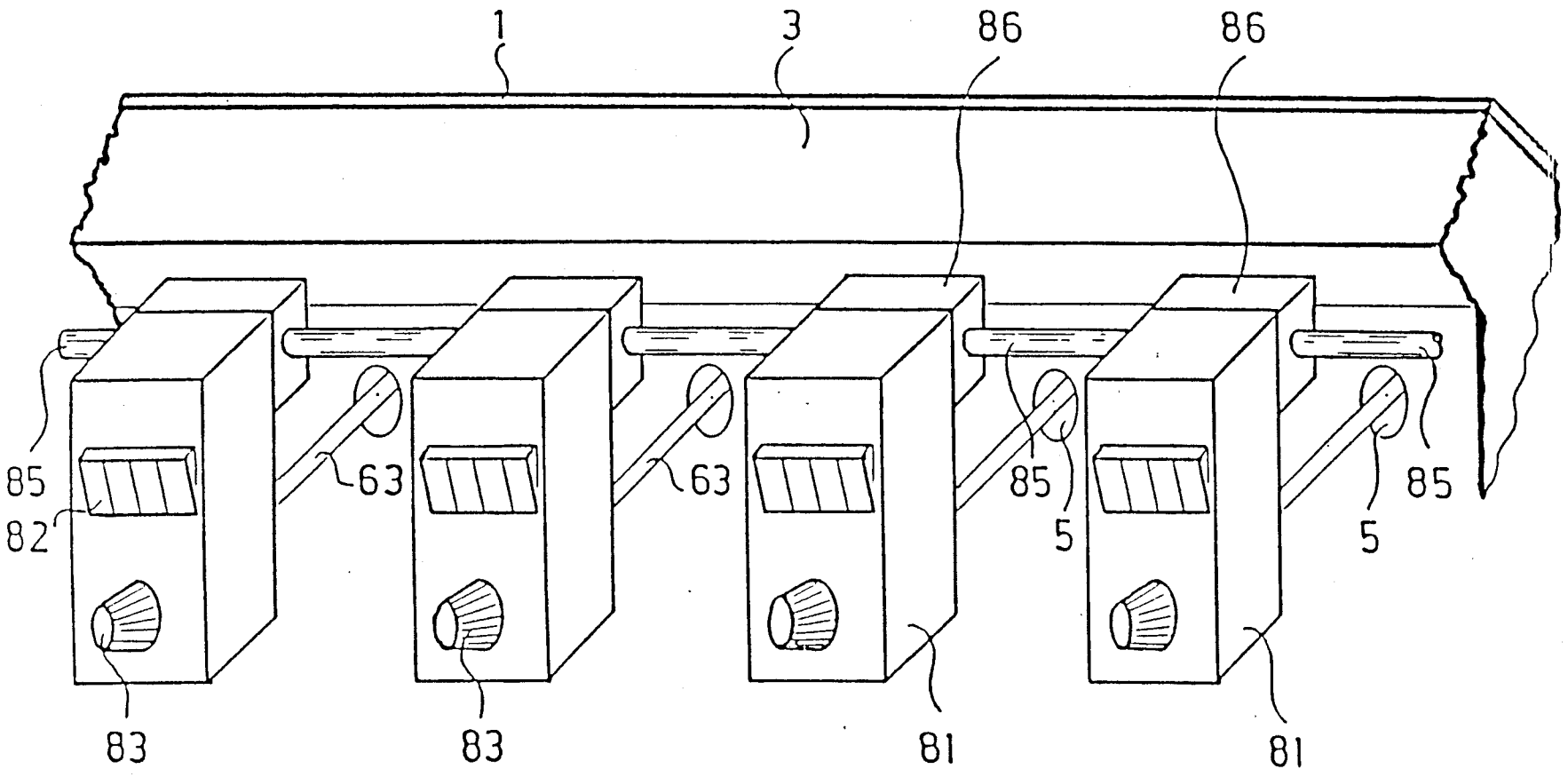
FIG. 2 is a partial perspective view.

A doctor blade is shown in FIG. 1, which has been divided into sections with cuts made vertically to its longitudinal direction. The division into sections of the doctor blade 1 makes setting of the ink supply easier, because setting in one section of the doctor blade 1 does not create forces which cause deformation of the doctor blade 1 in the adjacent sections. Together with the ductor roller 2 and the cross platen 3, on which the doctor blade 1 is mounted, the doctor blade 1 forms a part of the ink reservoir of the printing press, in which the printing ink 4 is stored.

Through-bores 5 are positioned in the cross platen 3 of the printing press, located on the press, which are directed to individual sections of the doctor blade 1. Each bore 5 has a widened section 51 which changes into a slightly tapered section with an interior thread 52. A set screw 6 is placed in each bore. The set screw 6 comprises two parts. It comprises a duct-adjusting screw 61 and a set bolt 62. The duct-adjusting screw 61 has a long, thin shank 63 which changes in the direction of the doctor blade 1 into a widened section 64, in which a blind bore with a thread is positioned. The set bolt 62 which has an exterior thread 66 on its end facing away from the doctor blade 1 is screwed into the blind bore having the interior thread 65. At its end facing the doctor blade 1, the set bolt 62 has a head 67 which rests form-fittingly and movably against the doctor blade 1, but is not rotatable with respect to the doctor blade 1.

On its widened section 64 the duct-adjusting screw 61 has an exterior thread 68, which interacts with the interior thread 52 of the through-bore 5 in the cross platen 3. The leads of the exterior thread 68 of the duct-adjusting screw 6 and of the exterior thread 66 of the set bolt 62 are different. This therefore has the result that for each revolution of the long shank 63 of the duct-adjusting screw 61, the set bolt 62 will only be displaced in relation to the doctor blade 1 by the difference between the leads of the two threads. It is thus possible to obtain an extremely exact adjustment of, for example, a tenth of a millimeter or less per revolution.

A counter 8 is placed on the end of the thin shaft 63. Such counters are commercially available in the form of potentiometer indicators. The counter 8 has a housing 81 in which a gear and a driving counter are positioned. The value of the driving counter can be directly read from an indicator 82. The driving counter is moved forward by one position with each complete rotation of the rotary knob 83. It is of course possible to position a reduction gear in the counter 8, but this should not be necessary according to this invention.

Each counter itself can be connected with the cross platen 3 of the printing press with appropriate fastening. However, this would be troublesome and would make a subsequent refitting of a printing press with the adjustment mechanism, according to this invention, more expensive and complicated. Since each set screw is already connected with the cross platen 3 anyway, and the counters are placed on these set screws, it is sufficient to secure the counters against rotation with respect to each other. According to this invention, this is accomplished in the simplest way by displacing each of the counter housings 81 by means of a horizontal slit forming a snug fit in a vertical direction, or by a through-bore 84 extending crosswise through the housing 81. If a rod, preferably a steel rod 85 is passed through all of the slits or bores 84 in the counters 8, all of the counters 8 are secured against rotation with respect to each other. So that this occurs with as little play as possible, the steel rod 85 should be fitted snugly into the bores 84 in the housings 81.

In many cases, when using commercially available counters 8, it will not be possible to obtain them with through-bores. It is therefore possible to attach, for example by gluing, a cuboid block, which has a through-bore 84, as a fastening element 86 on the back of the housing 81.

When using the adjustment mechanism in accordance with this invention, the procedure in connection with the first application is to close the set screw 6 itself in each section until no more ink transfer takes place. Then the counter 8 is set to zero. Thus all counters are set and the desired values per section can be set. These values, which vary in accordance with the printing set-up to be performed, can be recorded and stored with the printing set-up. When next using the same printing set-up again, it is possible immediately to reset the values, at least approximately, which only need to be adjusted in accordance with the wear of the doctor blade which has occurred. However, this can be done with little effort. Tests have shown that in this way it is possible to set the doctor blade in a fraction of the time required with conventional setting apparatuses, with corresponding savings of paper.

What is claimed is:

1. In an adjustment mechanism for setting doctor blades (1) used in offset printing presses, which are divided into sections and have a plurality of set screws (6), positioned next to each other, with duct-adjusting screws (61) for fine adjustment, which are in active frictional contact with one section of one of the doctor blades (1) facing a ductor roller (2), the improvement comprising each duct-adjusting screw (61) being rotatable for adjusting each said set screw (6) and having a counter (8) counting a number of rotations made.

2. In an adjustment mechanism according to claim 1, wherein each said set screw (6) comprises a duct-adjusting screw (61) and a set bolt (62), said duct-adjusting screw (61) can be rotated into and out of a cross platen (3) with an exterior thread (68) and said set bolt (62) in turn can be rotated into and out of said duct-adjusting screw (61) in a blind bore with an interior thread (65), and threads (68) of said duct-adjusting screw (61) in said cross platen (3) and of said set bolt (62) in said blind bore of said duct-adjusting screw (61) have different leads.

3. In an adjustment mechanism according to claim 1, wherein each of said counters (8) is provided for a purpose of reproducing setting of said doctor blade (1) and is connected with each other, fixed against rotation, with a continuous steel rod (85).

4. In an adjustment mechanism according to claim 3, wherein said steel rod (85) snugly fits through said counters (8) so as to be maintained in a form-fitting manner.

5. In an adjustment mechanism according to claim 4, wherein said counters (8) have fastening elements (86) on backs of said counters (8) through which said steel rod (85) passes with a snug fit.

6. In an adjustment mechanism according to claim 5, wherein said set screws (6) can be turned down sufficiently so that printing ink is not transferred and all said counters (B) are set to zero and are subsequently opened to supply a desired amount of ink.

7. In an adjustment mechanism according to claim 6, wherein optimum adjustment values of said doctor blade (1) obtained are read off said counters (8, 82) and can be immediately reset, at least approximately, when again using a same printing set-up.

8. In an adjustment mechanism according to claim 1, wherein said set screws (6) can be turned down sufficiently so that printing ink is not transferred and all said counters (8) are set to zero and are subsequently opened to supply a desired amount of ink.

9. In an adjustment mechanism according to claim 8, wherein optimum adjustment values of said doctor blade (1) obtained are read off said counters (8, 82) and can be immediately reset, at least approximately, when again using a same printing set-up.

* * * * *